US010566117B2

(12) United States Patent
Takeda et al.

(10) Patent No.: US 10,566,117 B2
(45) **Date of Patent: *Feb. 18, 2020**

(54) R-T-B BASED RARE EARTH PERMANENT MAGNET

(71) Applicant: TDK CORPORATION, Tokyo (JP)

(72) Inventors: Keiji Takeda, Tokyo (JP); Shota Miyazaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 265 days.

This patent is subject to a terminal disclaimer.

(21) Appl. No.: 15/649,048

(22) Filed: Jul. 13, 2017

(65) Prior Publication Data

US 2018/0040400 A1 Feb. 8, 2018

(30) Foreign Application Priority Data

Jul. 15, 2016 (JP) ..... 2016-140463

(51) Int. Cl.
*H01F 1/057* (2006.01)
*B22F 3/24* (2006.01)
(Continued)

(52) U.S. Cl.
CPC ..... *H01F 1/0577* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 7/02* (2013.01); *B22F 1/0011* (2013.01); *B22F 3/02* (2013.01); *B22F 3/10* (2013.01); *B22F 9/023* (2013.01); *B22F 2003/248* (2013.01); *B22F 2009/044* (2013.01); *B22F 2009/048* (2013.01);
(Continued)

(58) Field of Classification Search
None
See application file for complete search history.

(56) References Cited

U.S. PATENT DOCUMENTS

2014/0283649 A1 9/2014 Kunieda et al.
2015/0294770 A1 10/2015 Tanaka et al.
(Continued)

FOREIGN PATENT DOCUMENTS

JP S59-046008 A 3/1984
JP 2010-034522 A 2/2010
(Continued)

*Primary Examiner* — Xiaowei Su
(74) *Attorney, Agent, or Firm* — Oliff PLC

(57) ABSTRACT

An R-T-B based rare earth permanent magnet is expressed by a compositional formula: (R11−x(Y1−y−z Cey Laz)x) aTbBcMd in which R1 is one or more kinds of rare earth element not including Y, Ce and La, "T" is one or more kinds of transition metal, and includes Fe or Fe and Co as an essential component, "M" is an element having Ga or Ga and one or more kinds selected from Sn, Bi and Si, and $0.4 \le x \le 0.7$, $0.00 \le y+z \le 0.20$, $0.16 \le a/b \le 0.28$, $0.050 \le c/b \le 0.075$ and $0.005 \le d/b \le 0.028$. The magnet includes a main phase, including a compound having a R2T14B type tetragonal structure, and a grain boundary phase. D10, D50, D90 of crystal grain diameter according to the main phase crystal grains satisfies the following formula: $D50 \le 4.00$ μm and $(D90-D10)/D50 \le 1.60$. A coating rate of the grain boundary is 70.0% or more.

3 Claims, 6 Drawing Sheets

(51) Int. Cl.

| | |
|---|---|
| ***B22F 3/16*** | (2006.01) |
| ***C22C 38/00*** | (2006.01) |
| ***H01F 7/02*** | (2006.01) |
| ***C22C 38/10*** | (2006.01) |
| ***C22C 38/06*** | (2006.01) |
| ***C22C 38/14*** | (2006.01) |
| ***C22C 38/16*** | (2006.01) |
| *B22F 3/02* | (2006.01) |
| *B22F 1/00* | (2006.01) |
| *B22F 9/04* | (2006.01) |
| *B22F 3/10* | (2006.01) |
| *B22F 9/02* | (2006.01) |

(52) U.S. Cl.
CPC ..... *B22F 2998/10* (2013.01); *B22F 2999/00* (2013.01); *C22C 2202/02* (2013.01)

(56) References Cited

U.S. PATENT DOCUMENTS

| | | | | |
|---|---|---|---|---|
| 2015/0303744 | A1 | 10/2015 | Hashimoto et al. | |
| 2016/0086703 | A1* | 3/2016 | Suzuki | C22C 38/002 252/62.55 |
| 2016/0293304 | A1* | 10/2016 | Hirota | H01F 1/0536 |
| 2017/0278604 | A1* | 9/2017 | Une | C22C 38/06 |
| 2018/0040399 | A1* | 2/2018 | Miyazaki | H01F 1/0577 |

FOREIGN PATENT DOCUMENTS

| | | | | |
|---|---|---|---|---|
| JP | 2015-207662 | A | 11/2015 | |
| WO | WO-2014148146 | A1 * | 9/2014 | B22F 9/04 |

* cited by examiner

R-T-B BASED RARE EARTH PERMANENT MAGNET

BACKGROUND OF THE INVENTION

1. Field of the Invention

The present invention relates to an R-T-B based rare earth permanent magnet.

2. Description of the Related Art

R-T-B based rare earth permanent magnet including a tetragonal $R_2T_{14}B$ compound as its main phase is known to show a superior magnetic characteristic, and is a representative permanent magnet with a high performance since its invention in the year 1982. Note, "R" is a rare earth element and "T" is Fe or Fe partly substituted by Co.

R-T-B based rare earth permanent magnet, in which the rare earth element "R" is Nd, Pr, Dy, Ho or Tb, has a large anisotropic magnetic field Ha and preferable for a permanent magnet material. Among all, Nd—Fe—B based magnet, in which the rare earth element "R" is Nd, is well-balanced in saturation magnetization Is, Curie temperature Tc and anisotropic magnetic field Ha, and superior to R-T-B based rare earth permanent magnets using the other rare earth element "R" in quantity of resources and corrosion-resistance. Thus, Nd—Fe—B based magnet is widely used.

Permanent magnet synchronous motor has been used for a power drive of consumer products, industrial machines and transportation equipment. Permanent magnet synchronous motor in which a magnetic field of the permanent magnet is constant, an induction voltage increases in proportion to a rotational speed, and thus, driving thereof becomes difficult. Therefore, in medium and high speed ranges and under light load, a method called "a field-weakening control" came to be applied to permanent magnet synchronous motor, in order not to make induction voltage higher than the power supply voltage, making magnetic flux of the permanent magnet cancelled by a demagnetizing field due to armature current and interlinkage flux reduced. However, armature current, which does not contribute to a motor output, is continued to distribute in order to keep applying demagnetizing field. Thus, there is a problem that an efficiency of the motor is consequently reduced.

In order to solve such problems, as shown in Patent Document 2, a variable magnetic force motor using a Sm—Co based permanent magnet (a variable magnetic flux magnet) with a low coercive force which exhibits a reversible change in magnetization by applying external magnetic field has been developed. With the variable magnetic force motor, decrease in efficiency of the motor due to the conventional field-weakening control can be suppressed by reducing the magnetization of a variable magnetic flux magnet in medium and high speed ranges under light load.

With the Sm—Co based permanent magnet mentioned in Patent Document 2, there was a problem of being a high cost, due to expensive main materials: Sm and Co. Thus, an R-T-B based permanent magnet is applied as a permanent magnet for the variable magnetic flux magnet.

Patent Document 3 mentions the R-T-B based variable magnetic flux magnet including the main phase particles having a composition of $(R1_{1-x}R2_x)_2T_{14}B$, in which R1 is at least one kind of rare earth element not including Y, La and Ce, R2 is an rare earth element including one or more kind of Y, La and Ce, "T" is one or more kind of transition metal element and including Fe or Fe and Co as essential components, and $0.1 \leq x \leq 0.5$. The R-T-B based variable magnetic flux magnet further includes 2 at % to 10 at % of "M", in which "M" is at least one kind selected from Al, Cu, Zr, Hf and Ti. The R-T-B based variable magnetic flux magnet has a higher residual magnetic flux density relative to the conventional Sm—Co based permanent magnet for variable magnetic force motor. Thus, higher output and higher efficiency of the variable magnetic force motors are expected.

Patent Document 1: JP S59-46008A
Patent Document 2: JP 2010-34522A
Patent Document 3: JP 2015-207662A

DISCLOSURE OF THE INVENTION

Means for Solving the Problems

Normally, when magnetizing R-T-B based rare earth permanent magnet, a large magnetic field is applied to a degree to which magnetization of said magnet is saturated to obtain a high magnetic flux density and a high coercive force. The magnetizing field at the time is called a saturation magnetizing field.

On the other hand, with the variable magnetic force motor, the magnetization state of a variable magnetic flux magnet can be switched according to a minor loop of the magnetization by a magnetic field of such as an armature, when the variable magnetic flux magnet is incorporated in the motor. Thus, the motor can be driven with a high efficiency in a wide speed range regardless of a torque level. The minor loop here shows a magnetization change behavior, while sweeping a magnetic field from the field in the positive direction Hmag to the field in the reverse direction Hrev and back to Hmag.

Switching of the magnetization is performed by applying a magnetic field from the exterior, from such as a stator coil. Therefore, it is required to make magnetizing field Hmag required for the switching of the magnetization extremely smaller than the saturation magnetizing field, considering an energy saving and an upper limit of the possible external magnetic field. Considering above, coercive force of a variable magnetic flux magnet is required to be low at first.

In order to widen a high efficiency operational range, it is necessary to increase a change amount of magnetization of the variable magnetic flux magnet from magnetization state to demagnetization state. Therefore, a squareness ratio of the above minor loop is demanded to be high at first. In addition, in case of sweeping the magnetic field from reverse magnetic field Hrev to magnetic field Hmag in the minor loop, it is demanded that the magnetization does not change till the magnetic field is as close as Hmag. Hereinafter, this desired state is expressed as "the minor curve with a higher flatness".

As mentioned above, according to the general R-T-B based rare earth permanent magnet, the magnetic characteristics such as residual magnetic flux density, coercive force, and the like are evaluated after magnetizing the magnet in a saturation magnetizing field. In case when the magnetizing field is smaller than the saturation magnetizing field, magnetic characteristics are not evaluated.

Therefore, the present inventors evaluated the magnetic characteristics of R-T-B based rare earth permanent magnet in case when the magnetizing field is smaller than the saturation magnetizing field, and found that a squareness ratio of the minor loop and a flatness of the minor curve are deteriorated when the magnetizing field becomes small.

Namely, it was found that squareness ratio of the minor loop and flatness of the minor curve are influenced by the magnitude of magnetic field.

For instance, according to samples of Patent Article 3, when the magnetizing field is smaller than the saturation magnetizing field, the shape of hysteresis loop varies as shown in FIG. 5, even when they are measured on the same samples. FIG. 5A shows the hysteresis loop when the magnetizing field is 30 kOe, and FIG. 5B shows the hysteresis loop when the magnetizing field is 10 kOe. As obvious from FIGS. 5A and 5B, the shape of hysteresis loop greatly varies when the magnetizing field varies.

Comparing FIG. 5A and FIG. 5B, the squareness ratio and the flatness of minor curve of hysteresis loop in FIG. 5B is inferior to the same in FIG. 5A. Namely, the squareness ratio and the flatness of minor curve tend to be low when the magnetizing field becomes small. Although the squareness ratio of hysteresis loop in FIG. 5A is relatively good, similar to FIG. 5B, the minor curve flatness in hysteresis loop in FIG. 5A is as low as in FIG. 5B.

Therefore, R-T-B based rare earth permanent magnet according to Patent Article 3 shows low coercive force, however, the minor curve flatness is low after magnetized even in the saturation magnetizing field (FIG. 5A), and becomes further lower after magnetized in a lower magnetizing field (FIG. 5B), and the squareness ratio after magnetized in said lower magnetizing field also becomes lower. As a result, with the variable magnetic force motor, using R-T-B based rare earth permanent magnet according to Patent Article 3 as the variable magnetic flux magnet, there is a problem that the high efficiency operational range cannot be widened. In other word, as the characteristic required for a magnet preferable for the variable magnetic flux magnet, only the low coercive force is insufficient, and the squareness ratio and the minor curve flatness after magnetized in a low magnetizing field are also required to be high.

The present invention was devised considering the above situations. An object of the present invention is to provide an R-T-B based rare earth permanent magnet showing the low coercive force, and the high squareness ratio and the high minor curve flatness after magnetized even in a low magnetizing field, which is preferable for a variable magnetic force motor, capable to maintain a high efficiency in a wide rotational speed range, due to a high torque generation in a low-speed rotational zone and a low torque generation in a high-speed rotational zone.

R-T-B based rare earth permanent magnet has a nucleation-type magnetization reversal mechanism. Therefore, a movement of the magnetic domain wall is easily generated according to the applied external magnetic field, and the magnetization is greatly changed. Thus, the squareness ratio and the minor curve flatness become low after magnetized in a low magnetizing field. In order to increase the squareness ratio and the minor curve flatness after magnetized in a low magnetizing field according to R-T-B based rare earth permanent magnet, it is generally effective to increase the coercive force. Thus, according to R-T-B based rare earth permanent magnet, coexistence of the low coercive force and the high squareness ratio and the high minor curve flatness after magnetized in a low magnetizing field is difficult.

However, as a result of a keen examination, the inventors have found that a low magnetic field magnetizing characteristic can be improved by examining the composition realizing a low coercive force and examining a microstructure, leading to uniformity of nucleation field of reverse magnetic domain of each particle included in R-T-B based rare earth permanent magnet and to stabilization of a single domain structure when applying the magnetic field.

In order to solve the above problems and achieve the above object, the present invention provides an R-T-B based rare earth permanent magnet expressed by a compositional formula: $(R1_{1-x}(Y_{1-y-z}\ Ce_y\ La_z)_x)T_bB_cM_d$ in which, R1 is one or more kinds of rare earth element not including Y, Ce and La, "T" is one or more kinds of transition metal, and including Fe or Fe and Co as an essential component, "M" is an element including Ga or Ga and one or more kinds selected from Sn, Bi and Si, and $0.4 \le x \le 0.7$, $0.00 \le y+z \le 0.20$, $0.16 \le a/b \le 0.28$, $0.050 \le c/b \le 0.075$ and $0.005 \le d/b \le 0.028$, the R-T-B based rare earth permanent magnet includes the main phase, including a compound having $R_2T_{14}B$ type tetragonal structure, and the grain boundary phase, an average crystal grain diameter of main phase crystal grains satisfies the following formula: $D50 \le 4.00$ μm, a grain size distribution satisfies the following formula: $(D90-D10)/D50 \le 1.60$, in which D10, D50, D90 are area equivalent circle diameter, where cumulative distributions of cross sectional areas of the main phase crystal grains on an arbitrary cross section are 10%, 50% and 90%, respectively, and a coating rate of the grain boundary phase is 70.0% or more.

R-T-B based rare earth permanent magnet according to the invention satisfies the above compositional range, and in particular, the rare earth element R1, included in the main phase ($R_2T_{14}B$ phase) having an $R_2T_{14}B$ type tetragonal structure, is substituted by such as "Y". Thus the low coercive force is achieved. The magnetic anisotropy of $Y_2T_{14}B$ compound is inferior relative to the same of $R1_2T_{14}B$ compound including the rare earth element R1 (represented by Nd, Pr, Tb, Dy and Ho) included in the main phase. "Y" may be partly substituted by Ce, La. The anisotropic magnetic field of $Ce_2T_{14}B$ and $La_2T_{14}B$ compounds are inferior to the same of $R1_2T_{14}B$ compound included in the main phase, similar to the same of $Y_2T_{14}B$ compound. Thus, they are effective for obtaining the low coercive force. It is possible to efficiently obtain a low coercive force by making Ce, La amounts to the whole amounts of Y, Ce and La to $0.00 \le y+z \le 0.20$.

By making the atomic compositional ratio of "B" with respect to the same of transition metal element "T" and the atomic compositional ratio of an element "M" (an element including Ga or Ga and one or more of Sn, Bi and Si) with respect to the same of transition metal element "T" within the above compositional range, a structure including the main phase crystal grains composed of the compound having $R_2T_{14}B$ type tetragonal structure and the grain boundary phase can be obtained.

The average crystal grain diameter of the main phase crystal grains of the invention satisfies the following formula: $D50 \le 4.00$ μm, and the grain size distribution satisfies the following formula: $(D90-D10)/D50 \le 1.60$, in which D10, D50, D90 are area equivalent circle diameter, where cumulative distributions of cross sectional areas of the main phase crystal grains on an arbitrary cross section are 10%, 50% and 90%, respectively. Further, a coating rate of the grain boundary phase surrounding the main phase crystal grains is 70.0% or more. Thus, coercive force can be kept low, while the squareness ratio and the minor curve flatness after magnetized in a low magnetizing field can be increased.

The present inventors examined to increase the squareness ratio and the minor curve flatness after magnetized in a low magnetizing field in R-T-B based rare earth permanent magnet having the nucleation-type magnetization reversal mechanism. As a result, when magnetization of magnet during demagnetizing process is kept constant close to the negative coercive force after magnetized in a magnetic field in positive direction Hmag, the squareness ratio was confirmed to be high. In addition, when magnetization of magnet during remagnetizing process is kept constant close to the positive coercive force after demagnetized by a magnetic field in reverse direction Hrev, the minor curve flatness was confirmed to be high.

In order to keep the magnet magnetization constant during demagnetizing process after magnetized in a magnetic field in positive direction Hmag and magnetizing process from a magnetic field in reverse direction Hrev, it is effective that the main phase crystal grain included in R-T-B based rare earth permanent magnet become single domain state after magnetized in a low magnetizing field Hmag, the single domain state once formed is stable, and in addition, dispersion of the nucleation field of reverse magnetic domain is reduced. Supposing the main phase crystal grain is in a multidomain state, the magnetic domain wall moves freely according to the change of the magnetic field during the demagnetizing process and the magnetizing process because no pinning site exists in said main phase crystal grain. Therefore, magnetization of the magnet is not kept constant.

In addition, when dispersion of the nucleation field of reverse magnetic domain of each main phase crystal grain is large, magnetization of each main phase crystal grain is reversed at varied values of the magnetic field during demagnetizing process and magnetizing process, and therefore the magnetization of the whole magnet is not kept constant.

In order to realize the single domain state after magnetized in a low magnetizing field Hmag, decrease of a local demagnetization field is required. However, a large demagnetization field is applied locally to the main phase crystal grain in a general R-T-B based rare earth permanent magnet. Therefore, it is required to make an intensity of magnetizing field Hmag to be about 3 times larger than coercive force, in order to make all the main phase crystal grain to be the single domain state.

The local demagnetization field increases by a direct contact between an adjacent main phase crystal grains, a generation of edges on the surfaces of main phase crystal grains, which are not coated by the grain boundary phase, and etc.

Therefore, by making coating rate of the grain boundary phase in main phase crystal grain 70.0% or more, local demagnetization field can be reduced, and it becomes possible to realize single domain state in the low magnetizing field Hmag.

In order to stabilize the single domain state after magnetized, it is extremely important to control grain diameters of main phase crystal grains, considering a balance between magnetostatic energy and the magnetic domain wall energy. According to the invention, by setting an average crystal grain diameter of main phase crystal grain to $D50 \leq 4.00$ μm, the single domain structure can be stabilized after magnetized. In addition, the inventors found that dispersion of the nucleation field of reverse magnetic domain can be reduced by making the grain size distribution dispersion of the main phase crystal grains to satisfy the following formula: $(D90-D10)/D50 \leq 1.60$, since the nucleation field of reverse magnetic domain is associated with a grain diameter of main phase crystal grain.

In addition, even when an average grain diameter and the grain size distribution dispersion in the main phase crystal grains are controlled as mentioned above, the situation that many main phase crystal grains are magnetic exchange-coupling with adjacent main phase crystal grain can be regarded to be equivalent to the grain size distribution with a large dispersion in which the many main phase crystal grains with a large grain diameters are existing. Consequently, single domain state after magnetized is destabililzed, and the dispersion of the nucleation field of reverse magnetic domain become large. The present inventors have found that, according to the present composition, the main phase crystal grain is possible to have a structure in which 70% or more is coated by the grain boundary phase, having a sufficient thickness more than 3 nm to cut the magnetic exchange-coupling between the main phase crystal grains. Thus, the single domain state of main phase crystal grain is stabilized and the dispersion of the nucleation field of reverse magnetic domain can be decreased.

For the reasons above, in case when the average grain diameter, the grain size distribution, and the grain boundary phase coating rate according to the main phase crystal grains satisfy the above relations, the squareness ratio and the minor curve flatness after magnetized in a low magnetizing field can be increased.

According to the present invention, the R-T-B based rare earth sintered magnet preferable for a variable magnetic force motor, capable to maintain a high efficiency in a wide rotational speed range, due to a high torque generation in a low-speed rotational zone and a low torque generation in a high-speed rotational zone, showing a low coercive force and an outstandingly high squareness ratio and the minor curve flatness after magnetized in a low magnetizing field, can be provided. Note, R-T-B based rare earth sintered magnet of the invention can be applied to rotary machines in general such as a power generator in addition to the variable magnetic force motor.

DESCRIPTION OF THE PREFERRED EMBODIMENTS

Figure 1:
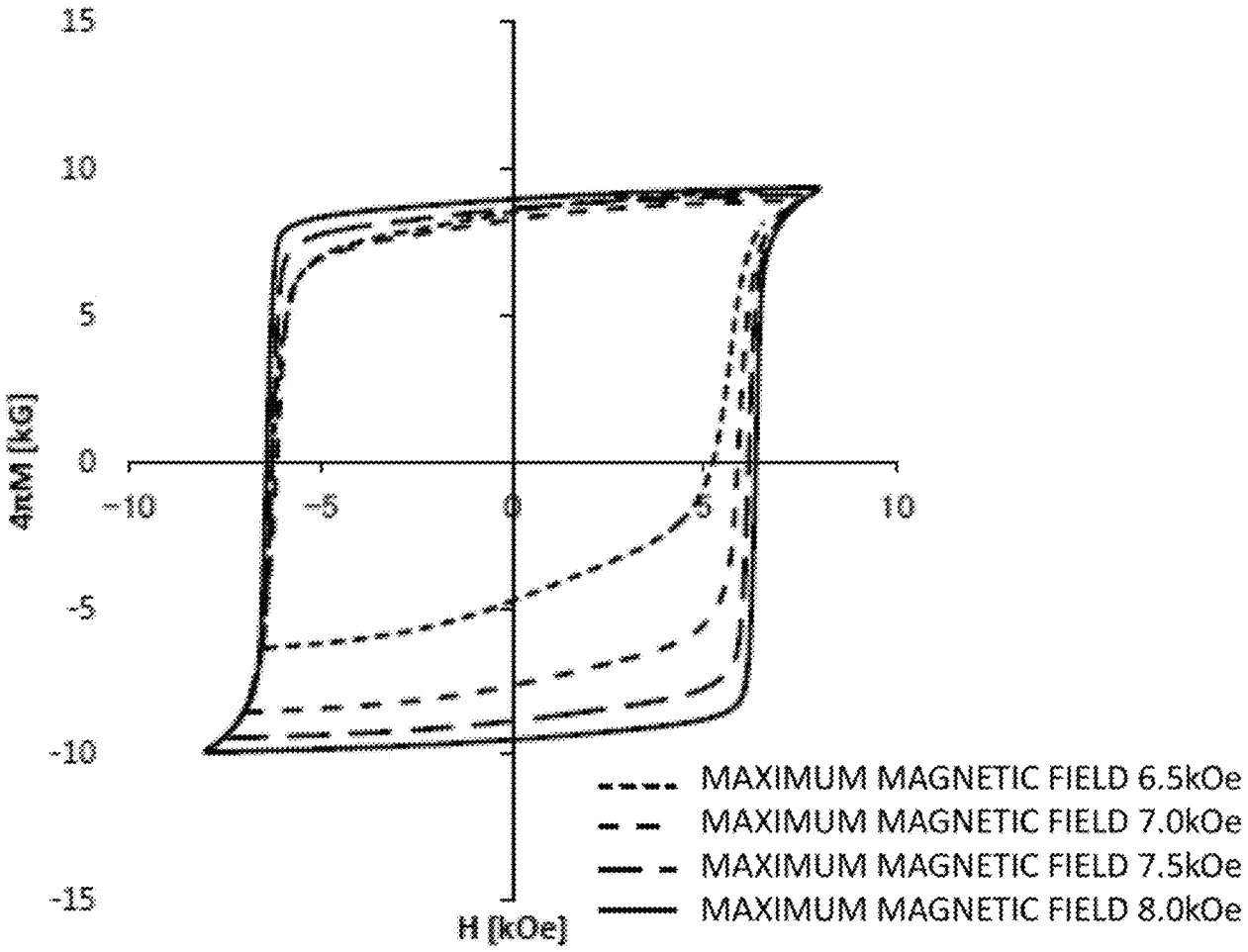
FIG. 1 is hysteresis loops measured by increasing the maximum magnetic field for measurement according to the samples of Ex. 3.

Hereinafter, the present invention will be described in detail based on the embodiments. The invention is not limited to the embodiments below. Component parts described below include, an easily estimated part by persons skilled in the art and a substantially identical part. In addition, the component parts described below can be suitably combined.

Compositional formula of R-T-B based rare earth permanent magnet according to the invention is $(R1_{1-x}(Y_{1-y-z}Ce_y La_z)_x)T_bB_cM_d$, in which R1 is one or more kinds of rare earth element not including Y, Ce and La, T is one or more kinds of transition metal, and includes Fe or Fe and Co as an essential component, M is an element comprising Ga or Ga and one or more kinds selected from Sn, Bi and Si, and $0.4 \leq x \leq 0.7$, $0.00 \leq y+z \leq 0.20$, $0.16 \leq a/b \leq 0.28$, $0.050 \leq c/b \leq 0.075$ and $0.005 \leq d/b \leq 0.028$, and the R-T-B based rare earth permanent magnet comprises a main phase, comprising a compound having an $R_2T_{14}B$ type tetragonal structure, and a grain boundary phase.

According to the present embodiment, the total atomic compositional ratio "x" of Y, Ce and La to the total atomic compositional ratio of all the rare earth element in the above compositional formula is $0.4 \leq x \leq 0.7$. In case when "x" is less than 0.4, the compositional ratio of Y, Ce and La to the compositional ratio of the whole sintered magnet becomes small, and the compositional ratio of Y, Ce and La in the main phase crystal grains is also low. Thus, a sufficient low coercive force cannot be obtained. In addition, in case when "x" is more than 0.7, the squareness ratio and the minor curve flatness after magnetized in a low magnetizing field becomes remarkably low.

This is due to the following. In the main phase ($R_2T_{14}B$ phase) composed of $R_2T_{14}B$ type tetragonal structure, $Y_2T_{14}B$ compound, $Ce_2T_{14}B$ compound and $La_2T_{14}B$ compound, which is inferior in the magnetic anisotropy in relative to such as $Nd_2T_{14}B$ compound including Nd as R1, have a significant influence.

In order to satisfy a low coercive force, and improve the squareness ratio and the minor curve flatness after magnetized in a low magnetizing field to be used in the variable magnetic force motor, "x" is preferably 0.5 or more. While "x" is preferably 0.6 or less.

According to the present embodiment, a total atomic compositional ratio (y+z) of Ce and La with respect to the total atomic compositional ratio Y, Ce and La is $0.00 \leq y+z \leq 0.20$. In case when y+z is larger than 0.20, the compositional ratio of "Y" to the crystal grain composition in the main phase is small, and that a sufficient low coercive force cannot be obtained. It is considered that this is due to an infection of $Ce_2T_{14}B$ compound, superior in anisotoropy relative to $Y_2T_{14}B$ compound, which becomes dominant in $R_2T_{14}B$ phase. In addition, y+z is preferably 0.09 or less. In this case, it becomes possible to further satisfy the low coercive force, and to improve the squareness ratio and the minor curve flatness after magnetized in a low magnetizing field.

According to the present embodiment, in order to obtain a high anisotropic magnetic field, rare earth element R1 is preferably one kind selected from Nd, Pr, Dy, Tb and Ho. Particularly in the corrosion-resistance view, Nd is preferable. Note, the rare earth element may include impurities derived from the raw material.

R-T-B based rare earth permanent magnet according to the present embodiment may include Fe or the other transition metal element in addition to Fe, as transition metal element "T" of a fundamental composition in $R_2T_{14}B$ phase. The transition metal element is preferably Co. In this case, content of Co is preferably 1.0 at % or less. Curie temperature is heightened and the corrosion-resistance is also improved by including Co in the rare earth magnet.

According to the present embodiment, the rate a/b, the atomic compositional ratio of rare earth element "R" to the atomic compositional ratio of transition metal element "T", is $0.16 \leq a/b \leq 0.28$. In case when a/b is less than 0.16, generation of $R_2T_{14}B$ phase included in R-T-B based rare earth permanent magnet is insufficient. Thus, a T-rich phase showing soft magnetism forms and the grain boundary (intergranular grain boundary), existing between the adjacent main phase crystal grains, having a thickness of 3 nm or more, sufficient to cut the magnetic exchange-coupling cannot be formed. Therefore, the squareness ratio and the minor curve flatness after magnetized in a low magnetizing field are lowered. On the other hand, in case when a/b is more than 0.28, coercive force becomes large. In order to satisfy a low coercive force, and improve the squareness ratio and the minor curve flatness after magnetized in a low magnetizing field to be used in the variable magnetic force motor, a/b is preferably 0.21 or more.

According to R-T-B based rare earth sintered magnet of the present embodiment, the rate c/b, the atomic compositional ratio of "B" to the same of transition metal element "T", is $0.050 \leq c/b \leq 0.075$. Intergranular grain boundary having a thickness sufficient to cut the magnetic exchange-coupling can be formed, by determining the content ratio of "B" within a specified rage.

Accordingly, main phase crystal grains are mutually magnetically separated. Thus, single domain state after magnetized can be stabilized and the squareness ratio and the minor curve flatness after magnetized in a low magnetizing field can be improved.

In case when c/b is less than 0.050, generation of $R_2T_{14}B$ phase is insufficient, a T-rich phase showing soft magnetism forms and it is not possible to make the thickness of the intergranular grain boundary sufficient to cut the magnetic exchange-coupling. In case when c/b is more than 0.075, the main phase ratio increases and the intergranular grain boundary having sufficient thickness cannot be formed similar to the above. Therefore, the squareness ratio and the minor curve flatness after magnetized in a low magnetizing field decrease. In order to satisfy a low coercive force, and improve the squareness ratio and the minor curve flatness after magnetized in a low magnetizing field, to be used in the variable magnetic force motor, c/b is preferably 0.058 or more. While, c/b is preferably 0.064 or less.

R-T-B based rare earth permanent magnet according to the present embodiment includes an element "M". Element "M" is Ga or Ga and one or more kind selected from Sn, Bi and Si. The rate d/b, the atomic compositional ratio of "M" to the atomic compositional ratio of transition metal element "T", is $0.005 \leq d/b \leq 0.028$. In case when d/b is smaller than 0.005 or when larger than 0.028, the intergranular grain boundary having a thickness sufficient to cut the magnetic exchange coupling cannot be formed in either case. Therefore, the squareness ratio and the minor curve flatness after magnetized in a low magnetizing field decrease. In order to secure a low coercive force, and improve the squareness ratio and the minor curve flatness after magnetized in a low magnetizing field, to be used in the variable magnetic force motor, d/b is preferably 0.008 or more. While, d/b is preferably 0.019 or less.

R-T-B based rare earth permanent magnet according to the present embodiment may include one or more kind of Al, Cu, Zr and Nb, promoting reaction during powder metallurgy process of main phase crystal grains. It is more preferable to include one or more kind of Al, Cu and Zr, and it is further preferable to include Al, Cu and Zr. Content amount of said elements are preferably 0.1 to 2 at % in total.

Reaction on a surface layer of the main phase crystal grains can be generated by adding the elements thereof to the rare earth magnet, and distortion, defect, and etc. can be removed.

According to the present embodiment, an average crystal grain diameter of the main phase crystal grains is D50≤4.00 μm. In order to improve the squareness ratio and the minor curve flatness after magnetized in a low magnetizing field, it is effective that single domain state after magnetized is stable. In case when D50 is more than 4.00 m, due to a balance between the magnetostatic energy and the magnetic domain wall energy, the multidomain structure rather than the single domain structure stabilizes in main phase crystal grains after magnetization, the magnetic domain wall moves freely in accordance with the change of magnetic field during demagnetizing process and magnetizing process. Thus, the squareness ratio and the minor curve flatness after magnetized in a low magnetizing field are deteriorated. For the stabilization of the single domain structure of the main phase crystal grains after magnetized, D50 is preferably 3.92 μm or less, more preferably 2.98 μm or less, and the most preferably 2.05 μm or less. In addition, an excessive refining of the grain diameter leads to a high coercive force, which is not suitable for the variable magnetic force motor. Therefore, in order to satisfy the low coercive force, D50 is preferably 1.01 μm or more, and it is more preferably 1.49 μm or more.

As an indicator showing the grain size distribution of the main phase crystal grains according to the present embodiment, (D90−D10)/D50 is used. According to the present embodiment, (D90−D10)/D50≤1.60. Note, according to the present embodiment, D50 is diameter (equivalent circle diameter) of a circle having an area, where cumulative distributions of areas of the main phase crystal grains become 50%, D90 is an equivalent circle diameter of an area, where cumulative distributions of areas of the main phase crystal grain become 90%, and D10 is an equivalent circle diameter of an area, where cumulative distributions of areas of the main phase crystal grain become 10%. Thus, a smaller (D90−D10)/D50 indicates a smaller dispersion in the grain size distribution of the main phase crystal grains.

In order to improve the squareness ratio and the minor curve flatness after magnetized in a low magnetizing field, it is effective to reduce dispersion of the nucleation field of reverse magnetic domain. The nucleation field of reverse magnetic domain depends on the grain diameter of the main phase crystal grains. Therefore, it is important to control the dispersion of the grain size distribution according to the main phase crystal grains, and it is preferably within the above range. In case when (D90−D10)/D50 is more than 1.60 and dispersion of the grain size distribution becomes large, dispersion of the nucleation field of reverse magnetic domain increases and the minor curve flatness lowers. In addition, in order to further decrease dispersion of the nucleation field of reverse magnetic domain, (D90−D10)/D50 is preferably 1.19 or less, and more preferably 0.99 or less.

In the present embodiment, the grain boundary phase is non-ferromagnetic, and the thickness of the grain boundary phase is preferably 3 nm or more and 1 μm or less. And the coating rate of the grain boundary phase, which is a ratio of the grain boundary phase coating outer periphery of the main phase crystal grains, is 70.0% or more. Even when the average grain diameter and the grain size distribution dispersion according to the main phase crystal grains are controlled as mentioned above, when the grain boundary phase coating rate is less than 70.0%, the main phase crystal grains magnetic exchange-coupling with adjacent main phase crystal grains increases, and exchange-coupled particles become magnetically equivalent to one main phase crystal grain having a large grain diameter. The existence of many main phase crystal grains having such magnetically large grain diameter means the coexistence of particles of large grain diameters (exchange-coupled particles) and particles of small grain diameters (not exchange-coupled particles), which regards as magnetically equivalent to a large dispersion state of the grain size distribution of main phase crystal grains. Consequently, the single domain state after magnetized is destabilized and dispersion of the nucleation field of reverse magnetic domain become large. Thus, the squareness ratio and the minor curve flatness after magnetized in a low magnetizing field are lowered.

In addition, in case when the grain boundary phase coating rate becomes less than 70.0%, the local demagnetization field increases by a direct contact between an adjacent main phase crystal grains, and by a generation of edges on the surfaces of main phase crystal grains which are not coated by the grain boundary phase. Consequently, the single domain state after magnetized in a low magnetizing field Hmag cannot be realized, and the squareness ratio and the minor curve flatness after magnetized in a low magnetizing field are lowered. In order to improve the squareness ratio and the minor curve flatness after magnetized in a low magnetizing field, the grain boundary phase coating rate is preferably 90.0% or more.

Note, the coating rate of the grain boundary phase is calculated as a ratio of the total length of an outline of the main phase crystal grains coated with the grain boundary phase having a predetermined thickness, with respect to a total length of an outline of the main phase crystal grains, on the cross section of R-T-B based permanent magnet.

R-T-B based rare earth permanent magnet according to the present embodiment may include oxygen as the other element. Content amount of oxygen is 2,000 to 8,000 ppma (parts per million atomic). In case when content amount of oxygen is smaller than said range, corrosion-resistance of a sintered magnet becomes insufficient, while when larger, a liquid phase in sintering is not sufficiently formed, the main phase crystal grains will not be sufficiently coated with the grain boundary phase, and the squareness ratio and the minor curve flatness after magnetized in a low magnetizing field are lowered. In order to make the squareness ratio and the minor curve flatness after magnetized in a low magnetizing field higher, it is preferably 2,500 to 7,000 ppma.

Content amount of "N" in R-T-B based rare earth permanent magnet according to the present embodiment is preferably 8,000 ppma or less. In case when "N" content is larger than said range, the squareness ratio and the minor curve flatness after magnetized in a low magnetizing field tend to be lower.

A preferable example according to the method for manufacturing the invention will be descried hereinafter.

A raw material alloy, which can provide R-T-B based rare earth permanent magnet having the composition used for the present invention, is prepared, when manufacturing R-T-B based rare earth permanent magnet of the present embodiment. The raw material alloy can be manufactured in a vacuum or an inert gas, desirably in Ar atmosphere, by a strip cast method or the other well-known dissolution methods.

The strip cast method is a method for obtaining an alloy in which a molten metal, obtained by dissolving a row material metal in non-oxide atmosphere such as Ar gas atmosphere, is extrude to the rolling roller surface. Rapidly cooled molten metal on the roll is rapid cooling solidified to a thin-plate or a thin-film (a flake). Such rapid cooling solidified alloy has a homogeneous structure having a crystal grain diameter of 1 μm to 50 μm.

The raw material alloy can be obtained by not only the strip cast method but dissolution methods such as a high frequency induction dissolution. Note, in order to prevent segregation after the dissolution, for instance, it can be inclined to a water-cooling copper plate and solidified. An alloy obtained by the reduction diffusion method can be used as the raw material alloy.

Rare earth metal, rare earth alloy, pure iron, ferroboron, alloys thereof, and etc. can be used as a raw material of the present embodiment. It may further include Al, Cu, Zr and Nb as additional elements. Content amount of said additional element is preferably 20,000 ppm or less. The squareness ratio and the minor curve flatness after magnetized in a low magnetizing field are lowered when said additional element content is larger than the range.

In order to obtain R-T-B based rare earth permanent magnet according to the invention, a method in which the magnet is manufactured from an alloy of a single kind, so-called a single alloy method, is basically applied to the raw material alloy, however, so-called mixing method using the main phase alloy (a low R alloy) mainly having $R_2T_{14}B$ crystal, which is main phase crystal grains, and an alloy (a high R alloy) including "R" more than said low R alloy and effectively contributes to the formation of grain boundary.

The raw material alloy is subjected to a pulverization process. In case of using the mixing method, the low R alloy and the high R alloy can be pulverized separately or collectively.

There are a coarse pulverization process and a fine pulverization process for the pulverization process. At first, the raw material alloy is coarsely pulverized till the grain diameter becomes about several hundreds μm. It is desirable that stamp mill, jaw crusher, brown mill and the like are used in the inert gas atmosphere for the coarse pulverization. In the coarse pulverization process, it is effectively pulverized when dehydrogenated after a hydrogen storage in a raw material alloy. The raw material alloy manufactured by the strip cast method has a structure in which the main phase component, having a width approximately equal to the target particle diameter during the fine pulverization, is separated by a dendrite shaped R-rich phase. A crack is generated by the expansion when hydrogen is stored in R-rich phase. Thus, pulverized efficiency is improved at the fine pulverization process after the coarse pulverization process, and inhibits dispersion of the grain size distribution of main phase crystal grains.

Hydrogen storage treatment is performed by exposing the raw material alloy in hydrogen gas of an atmospheric pressure. Holding temperature during the hydrogen storage is usually a room temperature. In case when "Y" content ratio in the rare earth element is high, however, the hydrogen storage in R-rich phase of a high "Y" content ratio becomes difficult with the room temperature. Therefore, the Holding temperature is preferably higher than the room temperature and may be 500° C. or less. The holding time varies according to the relation with the holding temperature, composition of a raw material alloy, weight, and the like, and it is set at least 30 minutes or more and desirably 1 hour or more per 1 kg. The dehydrogenation treatment after the hydrogen storage is performed in object to decrease hydrogen as an impurity for the rare earth sintered magnet.

Dehydrogenation treatment is performed by heating the raw material alloy in vacuum or inert gas atmosphere. Heat temperature is 200 to 400° C. or more, and desirably 300° C. The holding time varies according to the relation with the holding temperature, composition of a raw material alloy, weight, and the like, and it is set at least 30 minutes or more and desirably 1 hour or more per 1 kg. Hydrogen releasing treatment is performed in vacuum or in Ar gas flow. Note, hydrogen storage treatment and dehydrogenation treatment are not essential treatments. This waster pulverization is regarded as the coarse pulverization and a mechanical coarse pulverization may be abbreviated.

It moves to the fine pulverization process after the coarse pulverization process. Jet mill is mainly used for the fine pulverization, and coarsely pulverized powder having a grain diameter of around several hundreds μm is made to an average grain diameter of 1.2 to 4 μm, desirably 1.5 to 3 μm. Jet mill pulverizes by a method in which a high pressure inert gas is discharged from a narrow nozzle and generate a high speed gas flow, the coarsely pulverized powder is accelerated with this high speed gas flow, and a collision between coarsely pulverized powders or a collision with target or container wall is generated. The pulverized powder is classified by a classification rotor installed in pulverizer and a cyclone placed at lower section of the pulverizer.

A wet pulverization can be used for the fine pulverization. Ball mill, wet attritor, and etc. are used for the wet pulverization, and the coarsely pulverized powder having the grain diameter of around several hundreds μm is made to have an average grain diameter of 1.5 to 4 μm, desirably 2 to 3 μm. In the wet pulverization, with a selection of suitable dispersion medium, the pulverization is progressed without the magnet powder to be exposed to oxygen. Thus, a low oxygen density fine powder can be obtained.

According to the present embodiment, in order for the grain size distribution of crystal grains included in the main phase to satisfy the following formula: $(D90-D10)/D50 \leq 1.60$, it is preferable that the collected fine pulverization powder is poured again in jet mill after finely pulverized, and provide a process for a further classification.

With an addition of this classification process, fine pulverization powder having a further sharp grain size distribution can be obtained.

The fine pulverization powder is submitted to a molding process. Note, a fatty acid, derivatives thereof or a hydrocarbon can be added in order to improve lubrication and orientation when molding. For instance, the fatty acid group of stearic acid base, lauryl acid base or oleic acid base, such as zinc stearate, calcium stearate, aluminum stearate, amide stearate, amide laurate, amide oleate, ethylenebisisoamide stearate, and hydrocarbons of paraffin, naphthalene, and etc. may be added around 0.01 to 0.3 wt/o during the fine pulverization.

Molding pressure when molding in the magnetic field is 0.3 to 3 ton/cm$^2$ (30 to 300 MPa). The molding pressure may be constant from the beginning to the end of molding, gradually increased or gradually decreased, or irregularly changed. Orientation becomes good as the molding pressure is low, however, in case when the molding pressure is excessively low, strength of the molding body becomes insufficient and a handling problem is generated. Thus, the molding pressure is selected from the above range considering this point. The final relative density of a molded body obtained from molding in the magnetic field is generally 40 to 60%.

Magnetic field applied may be around 960 kA/m to 1,600 kA/m. The applied magnetic field is not limited to a static magnetic field, and it may be a pulse-like magnetic field. In addition, the static magnetic field and the pulse-like magnetic field can be simultaneously used.

The molded body is submitted to a sintering process. The sintering is processed in a vacuum or in an inert gas atmosphere. Holding temperature and holding time of the sintering are required to be regulated corresponding to conditions, such as the composition, the pulverization method, the difference between an average grain diameter and the grain size distribution. It may be approximately 1,000° C. to 1,200° C. for 1 minute to 20 hours, however, it is preferably 4 to 20 hours.

After the sintering, an aging treatment may be applied to the obtained sintered body. After going through this aging treatment, constitution of the grain boundary phase formed between adjacent $R_2T_{14}B$ main phase crystal grains is determined. The microstructure is controlled not only with this process, but it is also determined considering the balance between conditions of the above sintering process and state of the raw material fine powder. Therefore, considering heat treatment conditions and the microstructure of the sintered body, heat treatment temperature, time and cooling rate may be determined. Heat treatment may be progressed within a range of 400° C. to 900° C.

The rare earth magnet according to the present embodiment can be obtained by the method described above, however, said method for manufacturing the rare earth magnet is not limited thereto and can be suitably varied.

Definition and evaluation method of an indicator of magnetizing field Hmag, the squareness ratio and the minor curve flatness according to the present embodiment are described.

Measurement required for the evaluation is performed by BH tracer. In the present embodiment, the minimum necessary magnetic field in which the squareness ratio and the minor curve flatness have reproducibility to the repetitive measurement among a magnetizing field Hmag is determined as a minimum magnetizing field Hmag. Concrete evaluation is shown in FIG. 1, using samples of Ex. 3. Hysteresis loop is measured increasing the maximum magnetic field for measuring with constant interval of the magnetic field. In case when the hysteresis loop closes and shows a symmetric shape (difference of the coercive force between positive side and negative side is less than 5%), reproducibility is guaranteed to repetitive measurement. Thus, the obtained minimum necessary maximum magnetic field is defined as the minimum magnetizing field Hmag.

Next, the squareness ratio $Hk_{_Hmag}/HcJ_{_Hmag}$ of the minor loop measured after magnetized in the minimum magnetizing field Hmag is used as the squareness ratio after magnetized in the minimum magnetizing field. Here, $Hk_{_Hmag}$ is a value of magnetic field which is 90% of residual magnetic flux density $Br_{_Hmag}$ in the second quadrant of minor loop measured after magnetized in the minimum magnetizing field Hmag. And $HcJ_{_Hmag}$ is coercive force of the minor loop measured in the minimum magnetizing field Hmag.

Figure 2:
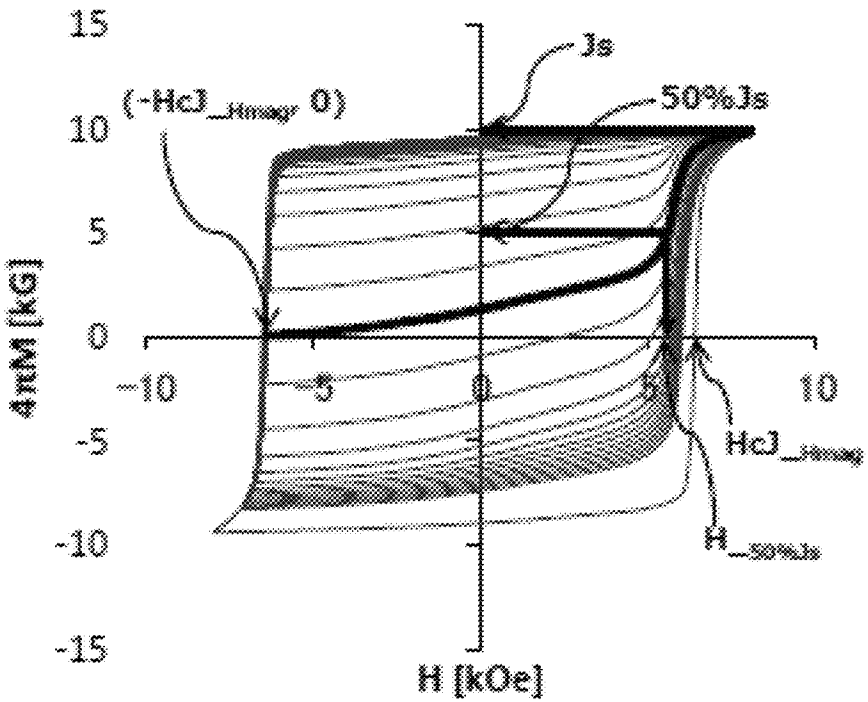
FIG. 2 is minor loops according to the samples of Ex. 3.

Indicator of the minor curve flatness is determined and evaluated as following. FIG. 2 shows minor loops measured by varying reverse magnetic field Hrev of the samples in Ex. 3. The indicator of the minor curve flatness is the ratio $H_{_50\%\ Js}/HcJ_{_Hmag}$, which is a ratio of $H_{_50\%\ Js}$, the magnetic field where the magnetic polarization becomes 50% of the magnetic polarization Js when the minimum magnetizing field Hmag is applied, to $HcJ_{_Hmag}$, the coercive force of the minor loop after magnetized in the minimum magnetizing field Hmag, according to the magnetization curve (a thick line in FIG. 2) from the operational point ($-HcJ_{_Hmag}$, 0), which is the coercive force at the second and third quadrants of the minor loops, among the magnetization curves from a plural reverse magnetic field Hrev.

To be used as the variable magnetic flux magnet, the minimum magnetizing field Hmag of rare earth magnet according to the present embodiment is preferably 8.0 kOe or less, and more preferably 6.0 kOe or less.

$HcJ_{_Hmag}$ of rare earth magnet after magnetized in the minimum magnetizing field according to the present embodiment is preferably 7.0 kOe or less, and more preferably 4.0 kOe or less.

$Hk_{_Hmag}/HcJ_{_Hmag}$ of rare earth magnet after magnetized in the minimum magnetizing field according to the present embodiment is preferably at least 0.80 or more, and more preferably 0.90 or more.

$Hk_{_50\%\ Js}/HcJ_{_Hmag}$ of rare earth magnet after magnetized in the minimum magnetizing field according to the present embodiment is preferably at least 0.50 or more, and more preferably 0.80 or more.

The average crystal grain diameter, the grain size distribution and the grain boundary phase coating rate in the main phase of the rare earth magnet according to the present embodiment can be evaluated by SEM (scanning electron microscope). The polished cross section of samples, in which the above magnetic characteristics are evaluated, is observed. And then main phase crystal grains and the other phases such as the grain boundary phase were confirmed by compositional image in backscattered electron mode (COMPO). Magnification is determined to be capable to recognize intergranular grain boundary phase having a predetermined thickness on the polished cross section of an observation object, such as a magnification of 5,000 or higher. The polished cross section may be parallel, orthogonal, or at an arbitrary angle to the orientation axis.

Figure 3:
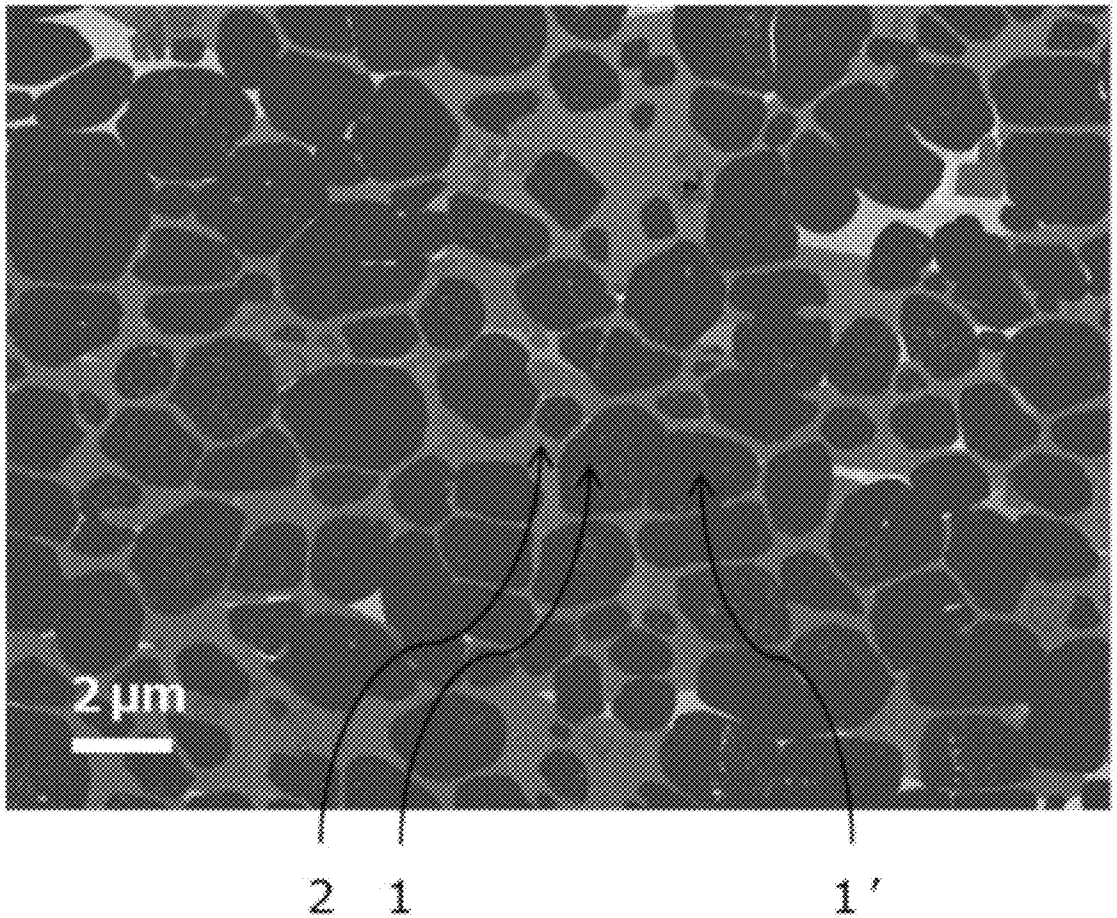
FIG. 3 is SEM backscattered electron image of cross section according to the samples of Ex. 3.
Figure 4:
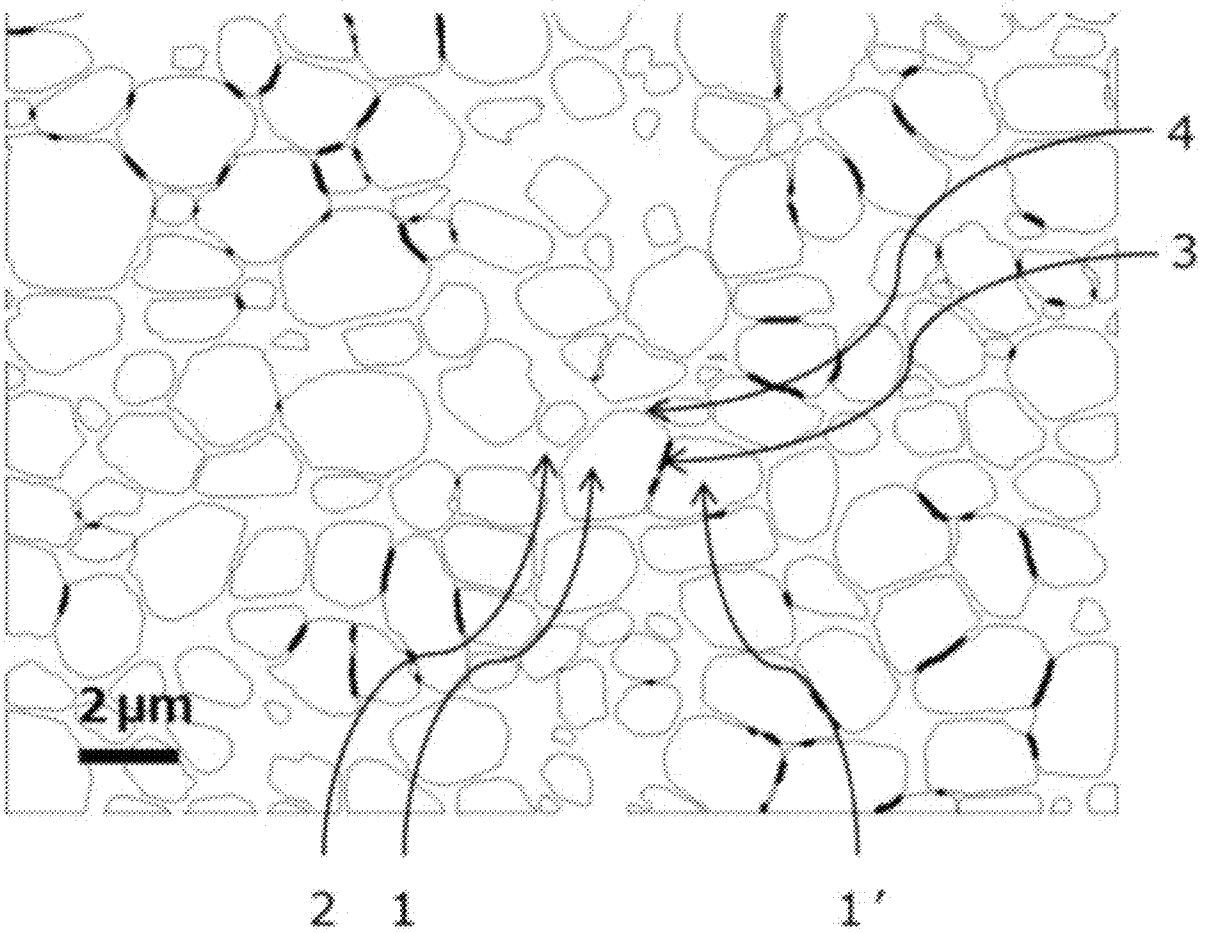
FIG. 4 is outlines of main phase crystal grains extracted by image analysis of the image in FIG. 3.
Figure 5A:
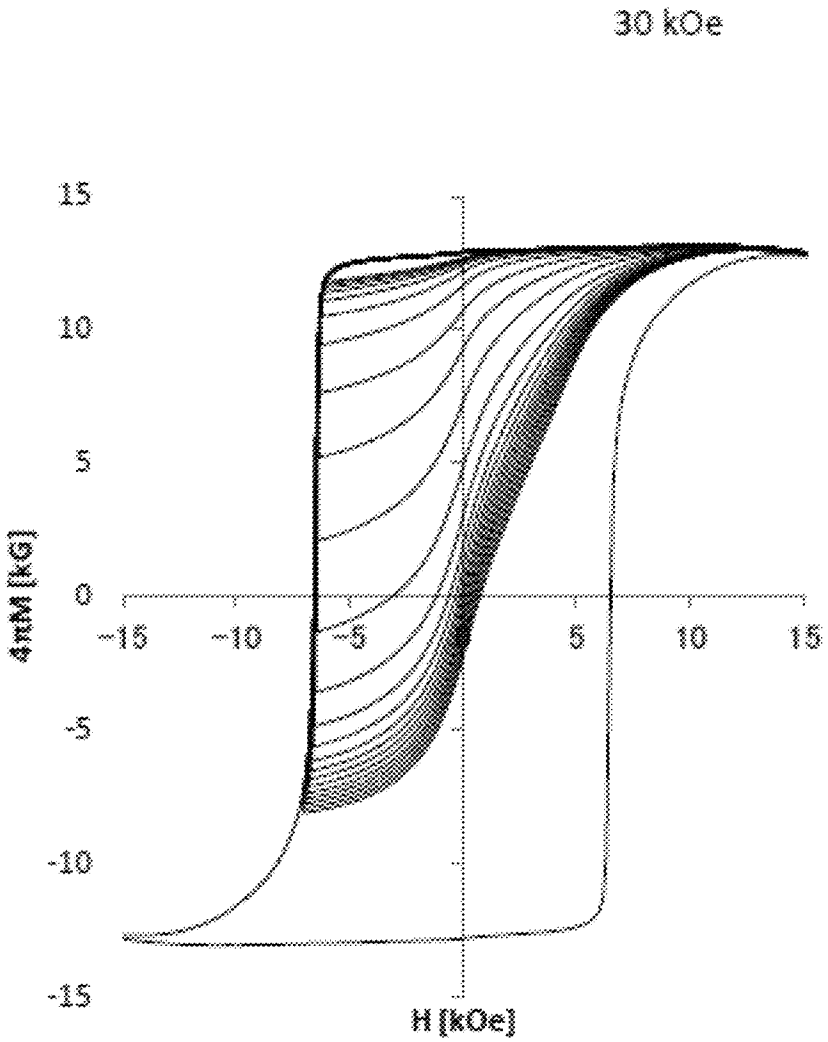
FIG. 5A is hysteresis loops according to the samples of Patent Article 3, when the magnetizing field is 30 kOe.
Figure 5B:
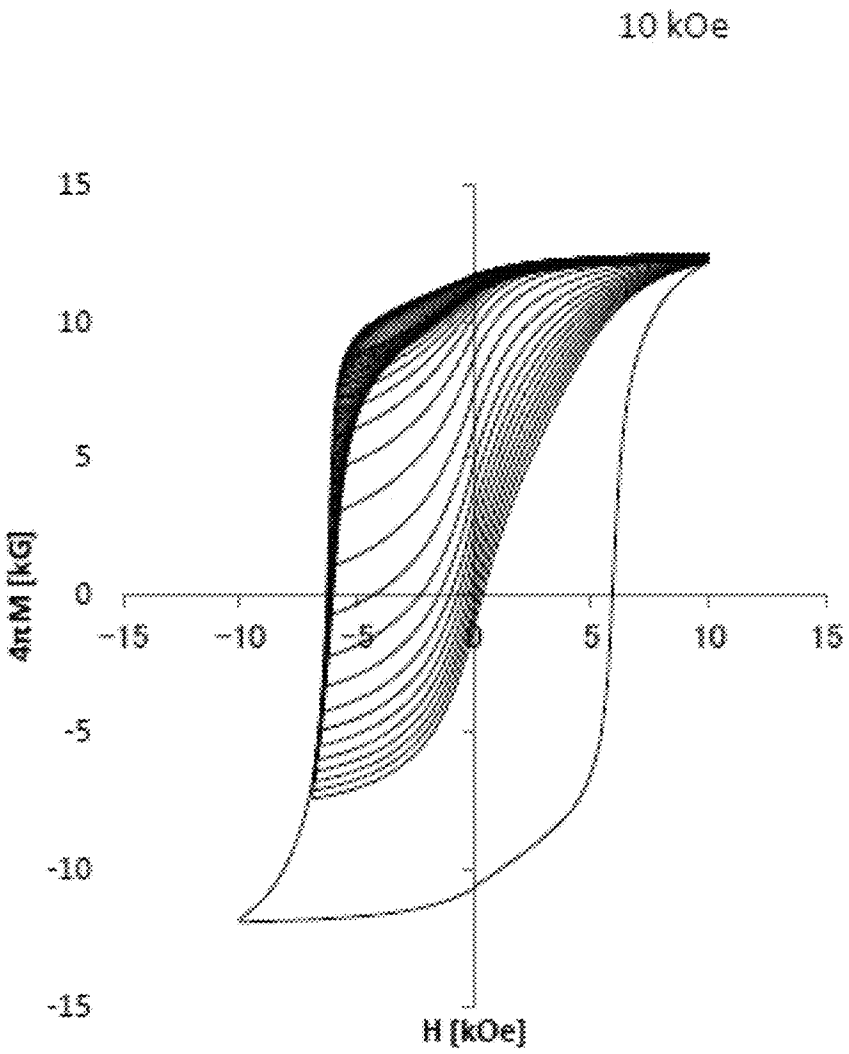
FIG. 5B is hysteresis loops according to the sample of Patent Article 3, when the magnetizing field is 10 kOe.

FIG. 3 shows SEM backscattered electron image of cross sectional area according to the sample in Ex. 3 (mentioned hereinafter). This image is read by the image analysis software, an outline of each main phase crystal grain 1 is extracted, and cross sectional area is obtained. In case when the area equivalent circle diameters where the cumulative areas of smaller particles are 10%, 50% and 90% of the entire area in the obtained cumulative distribution of the cross sectional areas of the main phase crystal grains are defined as D10, D50 and D90, respectively, the medium value D50 is defined as the average diameter of the main phase crystal grain and (D90−D10)/D50 is defined as the grain size distribution. There is no dispersion when the grain size distribution (D90−D10)/D50 is zero, and dispersion becomes large as the grain size distribution (D90−D10)/D50 is large. FIG. 4 shows an outline of the main phase crystal grains extracted from the image analysis of the image in FIG. 3.

In FIG. 4, among the outlines of each main phase crystal grain 1 extracted from SEM backscattered electron image, a length of part 3 contacting the other adjacent main phase crystal grain 1' and a length of part 4 contacting the grain boundary phase 2 are distinctly calculated according to each individual particle. Hereinafter, a ratio of a total length contacting the grain boundary phase with respect to a total length of outlines of all main phase crystal grains 1 is calculated as the grain boundary phase coating rate.

Here, in the grain boundary phase, a domain, having a contrast of a composition which differs from the main phase and having a sufficient width (20 nm in case when D50 is 1.0 μm or more and 5 nm in case when D50 is less than 1.0 μm), more than 3 nm to cut the exchange-couple, is recognized. And the outline part of the main phase crystal grains contacting said domain is detected as a contacting part with the grain boundary phase. A series of such measurement and calculation are performed on at least five fields in a cross section of the sample, and the mean value thereof is determined as a representative value of each parameter.

EXAMPLE

Hereinafter, the invention will be described in detail referring to examples and comparative examples, however, the invention is not limited thereto.

Examples 1 to 6

Raw materials were combined to obtain R-T-B based sintered magnet having a composition shown in Table 1, the raw materials were dissolved and casted by the strip cast method. Then a flake formed raw material alloy was obtained.

Next, a hydrogen pulverization treatment was performed in the following order. Hydrogen was stored in the raw material alloys at 500° C., a heat treatment was performed at 300° C. for 1 hour in Ar atmosphere, cooled thereof to a room temperature, and a heat treatment was performed again at 300° C. for 1 hour in a vacuum atmosphere. Subsequently, the obtained pulverized material was cooled to a room temperature in Ar atmosphere.

Next, 0.1 mass % of amide laurate as a pulverization aid was added to the hydrogen pulverization treated coarsely pulverized powder, and finely pulverized using jet mill. During the fine pulverization, rotational speed of classification rotor in jet mill was adjusted to make the average grain diameter of finely pulverized power to 1.7 μm. After the fine pulverization, the collected fine pulverization powder was poured in jet mill again and classified twice. Therefore, classification accuracy was heightened and dispersions of the grain size distribution were lowered.

The obtained fine pulverized powder was filled in a mold placed in an electro magnet, and a molding in the magnetic field was performed by applying a pressure of 120 MPa in the magnetic field of 1,200 kA/m.

Subsequently, the obtained molded body was sintered. Sintering was performed in vacuum at 1,030° C. for four hours, and then rapidly cooled to obtain the sintering body, the R-T-B based sintered magnet. The obtained sintered body was submitted to the aging treatment in Ar atmosphere at 590° C. for one hour, and each R-T-B based sintered magnet of Exs. 1 to 6 was obtained.

Note, in the present example, the above mentioned each step from the hydrogen pulverization treatment to sintering was performed in an inert gas atmosphere having an oxygen concentration of less than 50 ppm.

Compositional analysis of R-T-B based sintered magnet according to Exs. 1 to 6 was performed and the results are shown in Table 1. Content amount of each element shown in Table 1 was measured by Inductively Coupled Plasma Atomic Emission Spectrometry (ICP atomic emission spectrometry).

TABLE 1

| | Magnet Composition (at %) | | | | | | | | | | | | | | | | |
|---|---|---|---|---|---|---|---|---|---|---|---|---|---|---|---|---|---|
| | Nd | Y | Ce | La | Fe | Co | B | Ga | Al | Cu | Zr | x | y + z | a/b | c/b | d/b | |
| Experiment 1 | 12.57 | 5.13 | 0.00 | 0.00 | 75.08 | 0.56 | 4.61 | 1.37 | 0.52 | 0.06 | 0.10 | 0.3 | 0.00 | 0.23 | 0.061 | 0.018 | Comp. Ex. |
| Experiment 2 | 11.09 | 6.80 | 0.00 | 0.00 | 74.93 | 0.57 | 4.51 | 1.40 | 0.55 | 0.05 | 0.09 | 0.4 | 0.00 | 0.24 | 0.060 | 0.019 | Ex. |
| Experiment 3 | 9.38 | 8.71 | 0.00 | 0.00 | 74.71 | 0.57 | 4.52 | 1.41 | 0.54 | 0.07 | 0.10 | 0.5 | 0.00 | 0.24 | 0.060 | 0.019 | Ex. |
| Experiment 4 | 7.61 | 10.51 | 0.00 | 0.00 | 74.66 | 0.56 | 4.56 | 1.38 | 0.58 | 0.08 | 0.07 | 0.6 | 0.00 | 0.24 | 0.061 | 0.018 | Ex. |
| Experiment 5 | 5.40 | 12.61 | 0.00 | 0.00 | 74.77 | 0.58 | 4.59 | 1.32 | 0.57 | 0.05 | 0.11 | 0.7 | 0.00 | 0.24 | 0.061 | 0.018 | Ex. |
| Experiment 6 | 3.97 | 14.09 | 0.00 | 0.00 | 74.68 | 0.59 | 4.55 | 1.42 | 0.55 | 0.06 | 0.09 | 0.8 | 0.00 | 0.24 | 0.061 | 0.019 | Comp. Ex. |
| Experiment 7 | 9.16 | 8.01 | 0.38 | 0.42 | 74.34 | 0.56 | 4.48 | 1.37 | 0.53 | 0.07 | 0.10 | 0.8 | 0.09 | 0.24 | 0.059 | 0.018 | Ex. |
| Experiment 8 | 9.17 | 6.84 | 0.73 | 0.89 | 75.13 | 0.56 | 4.82 | 1.35 | 0.55 | 0.07 | 0.07 | 0.5 | 0.19 | 0.23 | 0.061 | 0.018 | Ex. |
| Experiment 9 | 9.40 | 5.96 | 1.22 | 1.49 | 74.75 | 0.57 | 4.54 | 1.37 | 0.55 | 0.04 | 0.10 | 0.5 | 0.31 | 0.24 | 0.060 | 0.018 | Comp. Ex. |
| Experiment 10 | 5.81 | 5.58 | 0.00 | 0.00 | 80.78 | 0.59 | 4.99 | 1.50 | 0.81 | 0.06 | 0.09 | 0.5 | 0.00 | 0.14 | 0.061 | 0.018 | Comp. Ex. |
| Experiment 11 | 6.54 | 6.28 | 0.00 | 0.00 | 79.51 | 0.62 | 4.78 | 1.50 | 0.52 | 0.07 | 0.11 | 0.5 | 0.00 | 0.16 | 0.060 | 0.019 | Ex. |
| Experiment 12 | 8.41 | 7.77 | 0.00 | 0.00 | 76.45 | 0.60 | 4.65 | 1.39 | 0.56 | 0.07 | 0.09 | 0.5 | 0.00 | 0.21 | 0.060 | 0.018 | Ex. |
| Experiment 13 | 10.44 | 10.03 | 0.00 | 0.00 | 72.56 | 0.56 | 4.51 | 1.30 | 0.48 | 0.05 | 0.05 | 0.5 | 0.00 | 0.28 | 0.062 | 0.018 | Ex. |
| Experiment 14 | 12.38 | 11.43 | 0.00 | 0.00 | 69.53 | 0.49 | 4.24 | 1.32 | 0.48 | 0.06 | 0.07 | 0.5 | 0.00 | 0.34 | 0.061 | 0.018 | Comp. Ex. |
| Experiment 15 | 9.33 | 8.61 | 0.00 | 0.00 | 76.45 | 0.55 | 3.00 | 1.42 | 0.49 | 0.09 | 0.09 | 0.5 | 0.00 | 0.23 | 0.039 | 0.019 | Comp. Ex. |
| Experiment 16 | 9.25 | 8.87 | 0.00 | 0.00 | 75.47 | 0.60 | 3.80 | 1.41 | 0.49 | 0.06 | 0.09 | 0.5 | 0.00 | 0.24 | 0.050 | 0.019 | Ex. |
| Experiment 17 | 9.26 | 8.90 | 0.00 | 0.00 | 74.72 | 0.65 | 4.37 | 1.40 | 0.53 | 0.06 | 0.10 | 0.5 | 0.00 | 0.24 | 0.058 | 0.019 | Ex. |
| Experiment 18 | 9.40 | 8.68 | 0.00 | 0.00 | 74.48 | 0.86 | 4.80 | 1.40 | 0.51 | 0.06 | 0.10 | 0.5 | 0.00 | 0.24 | 0.064 | 0.019 | Ex. |
| Experiment 19 | 9.18 | 8.82 | 0.00 | 0.00 | 74.41 | 0.57 | 4.95 | 1.39 | 0.53 | 0.07 | 0.09 | 0.5 | 0.00 | 0.24 | 0.066 | 0.019 | Ex. |
| Experiment 20 | 9.26 | 8.55 | 0.00 | 0.00 | 74.00 | 0.53 | 5.59 | 1.39 | 0.53 | 0.06 | 0.09 | 0.5 | 0.00 | 0.24 | 0.075 | 0.019 | Ex. |
| Experiment 21 | 9.19 | 8.49 | 0.00 | 0.00 | 73.42 | 0.54 | 6.36 | 1.32 | 0.52 | 0.06 | 0.10 | 0.5 | 0.00 | 0.24 | 0.086 | 0.018 | Comp. Ex. |
| Experiment 22 | 9.38 | 9.01 | 0.00 | 0.00 | 75.77 | 0.55 | 4.58 | 0.00 | 0.57 | 0.05 | 0.08 | 0.5 | 0.00 | 0.24 | 0.060 | 0.000 | Comp. Ex. |
| Experiment 23 | 9.38 | 8.64 | 0.00 | 0.00 | 75.68 | 0.59 | 4.64 | 0.38 | 0.54 | 0.06 | 0.10 | 0.5 | 0.00 | 0.24 | 0.061 | 0.005 | Ex. |
| Experiment 24 | 9.26 | 8.89 | 0.00 | 0.00 | 75.39 | 0.54 | 4.64 | 0.61 | 0.53 | 0.07 | 0.08 | 0.5 | 0.00 | 0.24 | 0.061 | 0.008 | Ex. |
| Experiment 25 | 9.09 | 9.09 | 0.00 | 0.00 | 75.12 | 0.52 | 4.64 | 0.83 | 0.56 | 0.06 | 0.09 | 0.5 | 0.00 | 0.24 | 0.061 | 0.011 | Ex. |
| Experiment 26 | 9.18 | 8.82 | 0.00 | 0.00 | 75.01 | 0.60 | 4.53 | 1.13 | 0.58 | 0.06 | 0.09 | 0.5 | 0.00 | 0.24 | 0.060 | 0.015 | Ex. |
| Experiment 27 | 8.34 | 8.62 | 0.00 | 0.00 | 74.61 | 0.57 | 4.47 | 1.65 | 0.55 | 0.07 | 0.10 | 0.5 | 0.00 | 0.24 | 0.060 | 0.022 | Ex. |
| Experiment 28 | 9.15 | 8.29 | 0.00 | 0.00 | 74.17 | 0.55 | 4.54 | 2.09 | 0.55 | 0.07 | 0.09 | 0.5 | 0.00 | 0.24 | 0.061 | 0.028 | Ex. |
| Experiment 29 | 9.02 | 8.67 | 0.00 | 0.00 | 74.06 | 0.56 | 4.39 | 2.61 | 0.53 | 0.07 | 0.09 | 0.5 | 0.00 | 0.24 | 0.059 | 0.035 | Comp. Ex. |
| Experiment 30 | 9.38 | 8.71 | 0.00 | 0.00 | 74.71 | 0.57 | 4.52 | 1.41 | 0.54 | 0.07 | 0.10 | 0.5 | 0.00 | 0.24 | 0.061 | 0.019 | Ex. |
| Experiment 31 | 9.38 | 8.71 | 0.00 | 0.00 | 74.71 | 0.57 | 4.52 | 1.41 | 0.54 | 0.07 | 0.10 | 0.5 | 0.00 | 0.24 | 0.061 | 0.019 | Ex. |
| Experiment 32 | 9.38 | 8.71 | 0.00 | 0.00 | 74.71 | 0.57 | 4.52 | 1.41 | 0.54 | 0.07 | 0.10 | 0.5 | 0.00 | 0.24 | 0.061 | 0.019 | Ex. |
| Experiment 33 | 9.38 | 8.71 | 0.00 | 0.00 | 74.71 | 0.57 | 4.52 | 1.41 | 0.54 | 0.07 | 0.10 | 0.5 | 0.00 | 0.24 | 0.061 | 0.019 | Ex. |
| Experiment 34 | 9.38 | 8.71 | 0.00 | 0.00 | 74.71 | 0.57 | 4.52 | 1.41 | 0.54 | 0.07 | 0.10 | 0.5 | 0.00 | 0.24 | 0.061 | 0.019 | Ex. |
| Experiment 35 | 9.38 | 8.71 | 0.00 | 0.00 | 74.71 | 0.57 | 4.52 | 1.41 | 0.54 | 0.07 | 0.10 | 0.5 | 0.00 | 0.24 | 0.061 | 0.019 | Comp. Ex. |
| Experiment 36 | 9.47 | 8.74 | 0.00 | 0.00 | 74.65 | 0.57 | 4.47 | 1.41 | 0.54 | 0.07 | 0.09 | 0.5 | 0.00 | 0.24 | 0.059 | 0.019 | Ex. |
| Experiment 37 | 9.18 | 8.82 | 0.00 | 0.00 | 74.75 | 0.57 | 4.56 | 1.41 | 0.56 | 0.06 | 0.08 | 0.5 | 0.00 | 0.24 | 0.061 | 0.019 | Ex. |
| Experiment 38 | 8.87 | 8.87 | 0.00 | 0.00 | 74.95 | 0.57 | 4.61 | 1.41 | 0.55 | 0.06 | 0.09 | 0.5 | 0.00 | 0.24 | 0.061 | 0.019 | Comp. Ex. |
| Experiment 39 | 11.09 | 6.80 | 0.00 | 0.00 | 75.50 | 0.00 | 4.51 | 1.40 | 0.55 | 0.05 | 0.09 | 0.4 | 0.00 | 0.24 | 0.060 | 0.019 | Ex. |

TABLE 1-continued

| | Magnet Composition (at %) | | | | | | | | | | | | | | | | |
|---|---|---|---|---|---|---|---|---|---|---|---|---|---|---|---|---|---|
| | Nd | Y | Ce | La | Fe | Co | B | Ga | Al | Cu | Zr | x | y + z | a/b | c/b | d/b | |
| Experiment 40 | 9.38 | 8.71 | 0.00 | 0.00 | 75.28 | 0.00 | 4.52 | 1.41 | 0.54 | 0.07 | 0.10 | 0.5 | 0.00 | 0.24 | 0.060 | 0.019 | Ex. |
| Experiment 41 | 7.61 | 10.51 | 0.00 | 0.00 | 75.22 | 0.00 | 4.56 | 1.38 | 0.58 | 0.08 | 0.07 | 0.6 | 0.00 | 0.24 | 0.061 | 0.018 | Ex. |

According to R-T-B based sintered magnet obtained in Exs. 1 to 6, the polished cross section parallel to the orientation axis was observed by SEM, the observed image was read by an image analysis software, and the average grain diameter D50 of the main phase crystal grains, the grain size distribution (D90−D10)/D50, and the grain boundary phase coating rate were evaluated. Results are shown in Table 2.

Magnetic characteristics of R-T-B based sintered magnet obtained in Exs. 1 to 6 were measured by BH tracer. As said magnetic characteristic, the above defined minimum magnetizing field Hmag, coercive force $HcJ_{_Hmag}$ of the minor hysteresis loop measured in the same minimum magnetizing field Hmag, the squareness ratio $Hk/HcJ_{_Hmag}$, and an indicator $Hk_{_50\ \%\ Js}/HcJ_{_Hmag}$ of the minor curve flatness were obtained. Results are shown in Table 2.

TABLE 2

| | Average Crystal Grain D50 (μm) | Grain Size Distribution (D90 − D10)/D50 | Coating Rate of the Grain Boundary Phase (%) | Minimum Magnetizing Field Hmag (kOe) | Coercive Force $HcJ_{—HmaQ}$ | Squareness Ratio $Hk_{—Hmag}/HcJ_{—Hmag}$ | Minor Curve Flatness $H_{—50\%Js}/HcJ_{—Hmag}$ | |
|---|---|---|---|---|---|---|---|---|
| Experiment 1 | 1.82 | 0.94 | 91.3 | 12.0 | 10.1 | 0.95 | 0.87 | Comp. Ex. |
| Experiment 2 | 1.83 | 0.93 | 92.0 | 8.0 | 7.0 | 0.95 | 0.87 | Ex. |
| Experiment 3 | 1.81 | 0.94 | 93.8 | 8.0 | 6.4 | 0.94 | 0.87 | Ex. |
| Experiment 4 | 1.81 | 0.94 | 91.0 | 8.0 | 5.3 | 0.95 | 0.81 | Ex. |
| Experiment 5 | 1.80 | 0.96 | 78.3 | 6.0 | 3.4 | 0.80 | 0.52 | Ex. |
| Experiment 6 | 1.82 | 0.93 | 65.4 | 4.0 | 1.8 | 0.58 | 0.32 | Comp. Ex. |
| Experiment 7 | 1.82 | 0.95 | 90.7 | 8.0 | 6.6 | 0.93 | 0.86 | Ex. |
| Experiment 8 | 1.80 | 0.96 | 90.3 | 8.0 | 7.0 | 0.85 | 0.81 | Ex. |
| Experiment 10 | 1.80 | 0.92 | 55.1 | 5.0 | 1.2 | 0.53 | 0.30 | Comp. Ex. |
| Experiment 11 | 1.82 | 0.95 | 76.2 | 6.0 | 2.3 | 0.93 | 0.50 | Ex. |
| Experiment 12 | 1.83 | 0.94 | 80.6 | 8.0 | 5.4 | 0.95 | 0.68 | Ex. |
| Experiment 13 | 1.82 | 0.96 | 91.2 | 8.0 | 6.9 | 0.93 | 0.87 | Ex. |
| Experiment 14 | 1.81 | 0.95 | 78.5 | 12.0 | 7.8 | 0.83 | 0.67 | Comp. Ex. |
| Experiment 15 | 2.03 | 1.25 | 57.3 | 6.0 | 2.4 | 0.75 | 0.21 | Comp. Ex. |
| Experiment 16 | 1.82 | 0.98 | 75.4 | 8.0 | 4.9 | 0.83 | 0.53 | Ex. |
| Experiment 17 | 1.80 | 0.96 | 90.3 | 8.0 | 5.7 | 0.90 | 0.80 | Ex. |
| Experiment 18 | 1.81 | 0.99 | 94.5 | 8.0 | 6.6 | 0.90 | 0.85 | Ex. |
| Experiment 19 | 1.83 | 0.99 | 80.2 | 8.0 | 4.7 | 0.98 | 0.65 | Ex. |
| Experiment 20 | 1.83 | 1.05 | 77.0 | 6.0 | 3.8 | 0.81 | 0.56 | Ex. |
| Experiment 21 | 2.01 | 1.18 | 48.8 | 4.0 | 1.9 | 0.70 | 0.15 | Comp. Ex. |
| Experiment 22 | 2.06 | 1.89 | 17.3 | 10.0 | 3.5 | 0.70 | 0.01 | Comp. Ex. |
| Experiment 23 | 1.81 | 0.97 | 84.7 | 8.0 | 5.7 | 0.87 | 0.72 | Ex. |
| Experiment 24 | 1.80 | 0.93 | 93.2 | 8.0 | 5.7 | 0.94 | 0.81 | Ex. |
| Experiment 25 | 1.81 | 0.94 | 92.9 | 8.0 | 5.8 | 0.95 | 0.82 | Ex. |
| Experiment 26 | 1.81 | 0.93 | 91.2 | 8.0 | 6.0 | 0.95 | 0.81 | Ex. |
| Experiment 27 | 1.80 | 0.98 | 81.4 | 8.0 | 5.8 | 0.95 | 0.74 | Ex. |
| Experiment 28 | 1.82 | 0.96 | 78.8 | 8.0 | 4.8 | 0.95 | 0.61 | Ex. |
| Experiment 29 | 1.93 | 1.21 | 68.7 | 7.0 | 3.9 | 0.76 | 0.48 | Comp. Ex. |
| Experiment 30 | 1.01 | 0.93 | 90.6 | 8.0 | 7.0 | 0.91 | 0.86 | Ex. |
| Experiment 31 | 1.49 | 0.94 | 93.0 | 8.0 | 6.8 | 0.94 | 0.91 | Ex. |
| Experiment 32 | 2.05 | 0.96 | 92.3 | 8.0 | 6.1 | 0.92 | 0.83 | Ex. |
| Experiment 33 | 2.98 | 0.95 | 91.0 | 8.0 | 5.5 | 0.90 | 0.80 | Ex. |
| Experiment 34 | 3.92 | 0.99 | 90.2 | 8.0 | 4.7 | 0.86 | 0.61 | Ex. |
| Experiment 35 | 4.85 | 1.02 | 90.3 | 8.0 | 3.6 | 0.75 | 0.48 | Comp. Ex. |
| Experiment 36 | 1.81 | 1.19 | 91.1 | 8.0 | 6.4 | 0.94 | 0.81 | Ex. |
| Experiment 37 | 1.80 | 1.58 | 90.5 | 8.0 | 6.3 | 0.89 | 0.72 | Ex. |
| Experiment 38 | 1.82 | 2.10 | 90.7 | 8.0 | 6.3 | 0.79 | 0.45 | Comp. Ex. |
| Experiment 39 | 1.83 | 0.95 | 90.8 | 8.0 | 6.8 | 0.92 | 0.85 | Ex. |
| Experiment 40 | 1.82 | 0.96 | 92.1 | 8.0 | 6.2 | 0.90 | 0.83 | Ex. |
| Experiment 41 | 1.81 | 0.95 | 90.1 | 8.0 | 5.2 | 0.91 | 0.81 | Ex. |

As shown in Table 2, R-T-B based sintered magnet according to Exs. 2 to 5 satisfy the minimum magnetizing field of 8.0 kOe or less and the coercive force in minimum magnetizing field is 7.0 kOe or less. The squareness ratio and the minor curve flatness are high after magnetized even in the minimum magnetizing field. Thus, in a range of $0.4 \leq x \leq 0.7$, it was confirmed that a low coercive force and a high squareness ratio and the minor curve flatness after magnetized in a low magnetizing field were obtained.

In addition, with R-T-B based sintered magnet of Exs. 2 to 4 satisfying $0.4 \leq x \leq 0.6$, it was also confirmed that a higher squareness ratio and the minor curve flatness can be obtained.

Exs. 3, 7 to 9

Raw materials were combined to obtain R-T-B based sintered magnet having a composition shown in Table 1, and similar to Ex. 1, casting of a raw material alloy, hydrogen pulverization treatment, fine pulverization by jet mill, molding, sintering and aging treatment were performed to each composition.

Similar to Ex. 1, the compositional analysis was performed to R-T-B based sintered magnet of Exs. 7 to 9, and the result is shown in Table 1. Evaluation results of the average grain diameter, the grain size distribution and the grain boundary phase coating rate according to the main phase crystal grains and measurement results of the magnetic characteristics are each shown in Table 2.

R-T-B based sintered magnet according to Exs. 3, 7 and 8 satisfy the minimum magnetizing field of 8.0 kOe or less and the coercive force in minimum magnetizing field of 7.0 kOe or less. The squareness ratio and the minor curve flatness are high even in the minimum magnetizing field. Thus, in a range of $0.00 \leq y+z \leq 0.20$ it was confirmed that a low coercive force and a high squareness ratio and the minor curve flatness after magnetized in a low magnetizing field were obtained. In particular, with R-T-B based sintered magnet according to Exs. 3 and 7 satisfying $0.00 \leq y+z \leq 0.10$, it was confirmed that a high squareness ratio and the minor curve flatness can be obtained Exs. 3, 10 to 14

Raw materials were combined to obtain R-T-B based sintered magnet having a composition shown in Table 1, and similar to Ex. 1, casting of a raw material alloy, hydrogen pulverization treatment, fine pulverization by jet mill, molding, sintering and aging treatment were performed to each composition.

Similar to Ex. 1, the compositional analysis was performed to R-T-B based sintered magnet of Exs. 10 to 14, and the result is shown in Table 1. Evaluation results of the average grain diameter, the grain size distribution and the grain boundary phase coating rate according to the main phase crystal grains and measurement results of the magnetic characteristics are each shown in Table 2.

R-T-B based sintered magnet according to Exs. 3, 11 to 13 satisfy the minimum magnetizing field of 8.0 kOe or less and the coercive force in minimum magnetizing field of 7.0 kOe or less. The squareness ratio and the minor curve flatness are high even in the minimum magnetizing field. Thus, in a range of $0.16 \leq a/b \leq 0.28$ it was confirmed that a low coercive force and a high squareness ratio and the minor curve flatness after magnetized in a low magnetizing field were obtained. In particular, with R-T-B based sintered magnet according to Exs. 3 and 13 satisfying $0.24 \leq a/b \leq 0.28$, it was confirmed that higher squareness ratio and the minor curve flatness can be obtained Exs. 3, 15 to 21

Raw materials were combined to obtain R-T-B based sintered magnet having a composition shown in Table 1, and similar to Ex. 1, casting of a raw material alloy, hydrogen pulverization treatment, fine pulverization by jet mill, molding, sintering and aging treatment were performed.

Similar to Ex. 1, the compositional analysis was performed to R-T-B based sintered magnet of Exs. 15 to 21, and the result is shown in Table 1. Evaluation results of the average grain diameter, the grain size distribution and the grain boundary phase coating rate according to the main phase crystal grains and measurement results of the magnetic characteristics are each shown in Table 2.

R-T-B based sintered magnet according to Exs. 3, 16 to 20 satisfy the minimum magnetizing field of 8.0 kOe or less and the coercive force in minimum magnetizing field of 7.0 kOe or less. The squareness ratio and the minor curve flatness are high even in the minimum magnetizing field. Thus, in a range of $0.05 \leq c/b \leq 0.075$ it was confirmed that a low coercive force and a high squareness ratio and the minor curve flatness after magnetized in a low magnetizing field were obtained. In particular, with R-T-B based sintered magnet according to Exs. 3, 17 and 18 satisfying $0.058 \leq c/b \leq 0.064$, it was confirmed that a high squareness ratio and the minor curve flatness can be obtained Exs. 3, 22 to 29

Raw materials were combined to obtain R-T-B based sintered magnet having a composition shown in Table 1, and similar to Ex. 1, casting of a raw material alloy, hydrogen pulverization treatment, fine pulverization by jet mill, molding, sintering and aging treatment were performed.

Similar to Ex. 1, the compositional analysis was performed to R-T-B based sintered magnet of Exs. 22 to 29, and the result is shown in Table 1. Evaluation results of the average grain diameter, the grain size distribution and the grain boundary phase coating rate according to the main phase crystal grains and measurement results of the magnetic characteristics are each shown in Table 2.

R-T-B based sintered magnet according to Exs. 3, 23 to 28 satisfy the minimum magnetizing field of 8.0 kOe or less and the coercive force in minimum magnetizing field of 7.0 kOe or less. The squareness ratio and the minor curve flatness are high even in the minimum magnetizing field. Thus, in a range of $0.005 \leq d/b \leq 0.028$ it was confirmed that a low coercive force and a high squareness ratio and the minor curve flatness after magnetized in a low magnetizing field were obtained. In particular, with R-T-B based sintered magnet according to Exs. 3, 24 to 26 satisfying $0.008 \leq d/b \leq 0.015$, it was confirmed that a high squareness ratio and the minor curve flatness can be obtained Among the R-T-B based sintered magnet according to Exs. 1 to 29, R-T-B based sintered magnet according to Exs. 2 to 5, 7, 8, 11 to 13, 16 to 20 and 23 to 28, satisfying the minimum magnetizing field of 8.0 kOe or less and the coercive force in minimum magnetizing field of 7.0 kOe or less and having a high squareness ratio and the minor curve flatness even in the minimum magnetizing field, satisfied the grain boundary phase coating rate of 70.0% or more. In addition, R-T-B based sintered magnet according to Exs. 2 to 4, 7, 8, 13, 17, 18 and 24 to 26 having higher squareness ratio and the minor curve flatness satisfied the grain boundary phase coating rate of 90.0% or more.

Exs. 3, 30 to 35

0.1 mass % of amide laurate as a pulverization aid was added to the hydrogen pulverization treated coarsely pulverized powder of Ex. 3 in Table 1, and finely pulverized using jet mill. During the fine pulverization, classification conditions of jet mill was adjusted to make the average grain diameter of finely pulverized power to 1.0 μm in Ex. 30, 1.4 μm in Ex. 31, 1.9 μm in Ex. 32, 1.7 μm in Ex. 33, 2.7 μm in Ex. 34 and 4.7 μm in Ex. 35. After the fine pulverization, the collected fine pulverization powder was poured in jet mill again and further classified accurately.

Molding, sintering and aging treatments were performed to the obtained each fine pulverized powder, similar to Ex. 1.

R-T-B based sintered magnet according to Exs. 30 to 35 was submitted to compositional analysis similar to Ex. 1, and the results are shown in Table 1. The evaluation results of the average grain diameter, the grain size distribution and the grain boundary phase coating rate of the main phase crystal grains and measurement results of the magnetic characteristics are both shown in Table 2.

R-T-B based sintered magnet according to Exs. 3, 30 to 34 satisfy the minimum magnetizing field of 8.0 kOe or less and the coercive force in minimum magnetizing field of 7.0 kOe or less. The squareness ratio and the minor curve flatness are high even in the minimum magnetizing field. Thus, in a range of D50≤4.00 μm, it was confirmed that a low coercive force and a high squareness ratio and the minor curve flatness after magnetized in a low magnetizing field were obtained. In particular, with R-T-B based sintered magnet according to Exs. 3 and 30 to 33 satisfying D50≤3.00 μm, it was confirmed that a high squareness ratio and the minor curve flatness can be obtained Exs. 3, 36 to 38

A hydrogen pulverization treatment was performed to the raw material alloy cast in Ex. 3 of Table 1 in the following order. Hydrogen was stored in the raw material alloy at room temperature, a heat treatment was performed at 300° C. for 1 hour in Ar atmosphere, cooled thereof to a room temperature, and a heat treatment was performed again at 300° C. for 1 hour in a vacuum atmosphere. In Ex. 38, hydrogen pulverization treatment was not performed and the mechanical coarse pulverization was performed by a stamp mill.

Next, 0.1 mass % of amide laurate as a pulverization aid was added to the coarsely pulverized powder under each condition and finely pulverized using jet mill. During the fine pulverization, classification conditions in jet mill were adjusted to make the average grain diameter of finely pulverized power to 1.7 μm. In Ex. 36, after the fine pulverization process, the collected fine pulverization powder was poured in jet mill again and further classified accurately.

Molding, sintering and aging treatments were performed to the obtained each fine pulverized powder, similar to Ex. 1.

Similar to Ex. 1, R-T-B based sintered magnets according to Exs. 36 to 38 were submitted to compositional analysis, and the results are shown in Table 1. The evaluation results of the average grain diameter, the grain size distribution and the grain boundary phase coating rate of the main phase crystal grains and measurement results of the magnetic characteristics are both shown in Table 2.

R-T-B based sintered magnet according to Exs. 3, 36 and 37 satisfy the minimum magnetizing field of 8.0 kOe or less and the coercive force in minimum magnetizing field of 7.0 kOe or less. The squareness ratio and the minor curve flatness are high even in the minimum magnetizing field. Thus, in a range of (D90−D0)/D50≤1.60, it was confirmed that a low coercive force and a high squareness ratio and the minor curve flatness after magnetized in a low magnetizing field were obtained. In particular, with R-T-B based sintered magnet according to Exs. 3 and 36 satisfying (D90−D10)/D50≤1.20, it was confirmed that a high squareness ratio and the minor curve flatness can be obtained.

Exs. 2 to 4 and 39 to 41

Raw materials were combined to obtain R-T-B based sintered magnet having a composition shown in Table 1, and similar to Exs. 2 to 4, casting of a raw material alloy, hydrogen pulverization treatment, fine pulverization by jet mill, molding, sintering and aging treatment were performed.

Similar to Ex. 1, the compositional analysis was performed to R-T-B based sintered magnet of Exs. 39 to 41, and the result is shown in Table 1. Evaluation results of the average grain diameter, the grain size distribution and the grain boundary phase coating rate according to the main phase crystal grains and measurement results of the magnetic characteristics are each shown in Table 2.

R-T-B based sintered magnet according to Exs. 39 to 41 satisfy the minimum magnetizing field of 8.0 kOe or less and the coercive force in minimum magnetizing field of 7.0 kOe or less. The squareness ratio and the minor curve flatness are also high even in the minimum magnetizing field. Thus, it was confirmed that the same effect can be obtained even when Fe is not partly substituted by Co.

Hereinbefore, the invention is described based on the embodiments. The embodiments are examples and can be varied within the scope of the claims of the invention. It is also realized by person in the art that such variations are within the scope of the claims of the invention. Therefore, description of the specification is not limited thereto and is treated as an exemplification.

INDUSTRIAL APPLICABILITY

According to the present invention, R-T-B based rare earth permanent magnet, preferable for the variable magnetic force motor capable to maintain a high efficiency in a wide rotational speed range, can be provided.

NUMERICAL REFERENCES

1 . . . main phase crystal grains
1' . . . main phase crystal grains
2 . . . grain boundary phase
3 . . . a part where an outline of the cross section of the main phase crystal grains contacts the grain boundary
4 . . . a part where an outline of the cross section of the main phase crystal grains contacts the main phase crystal grains

The invention claimed is:

1. An R-T-B based rare earth permanent magnet expressed by a compositional formula: $(R1_{1-x}(Y_{1-y-z}Ce_yLa_z)_x)T_bB_cM_d$ wherein, R is a rare earth element, R1 is one or more kinds of rare earth element not including Y, Ce and La, T is one or more kinds of transition metal, and includes Fe or Fe and Co as an essential component, M is an element comprising Ga or Ga and one or more kinds selected from Sn, Bi and Si, x, y, z, a, b, c, and d are atomic ratios, $0.4 \leq x \leq 0.7$, $0.00 \leq y+z \leq 0.20$, $0.16 \leq a/b \leq 0.28$, $0.050 \leq c/b \leq 0.075$ and $0.005 \leq d/b \leq 0.028$, the R-T-B based rare earth permanent magnet comprises a main phase, comprising a compound having an $R_2T_{14}B$ type tetragonal structure, and a grain boundary phase, an average crystal grain diameter of a main phase crystal grain satisfies the following formula: $D50 \leq 4.00$ μm, a grain size distribution satisfies the following formula: $(D90-D10)/D50 \leq 1.60$, wherein D10, D50, D90 are area equivalent circle diameter, where cumulative distributions of a cross sectional area of the main phase crystal grain on an arbitrary cross section are 10%, 50% and 90%, respectively, a coating rate of the grain boundary phase is 70.0% or more, and a coercive force ($HcJ_{_Hmag}$) is 7.0 kOe or less.

2. The R-T-B based rare earth permanent magnet according to claim 1, wherein the average crystal grain diameter of the main phase crystal grain satisfies the following formula: $D50 \leq 3.00$ μm, the grain size distribution satisfies the following formula: $(D90-D10)/D50 \leq 1.20$, and the coating rate of the grain boundary phase is 90.0% or more.

3. The R-T-B based rare earth permanent magnet according to claim 1, wherein the coercive force $HcJ_{_Hmag}$) is 4.0 kOe or less.

* * * * *